US011158983B2

(12) United States Patent
Gassner

(10) Patent No.: US 11,158,983 B2
(45) Date of Patent: Oct. 26, 2021

(54) USB SOCKET, BUTTON CONTROLLER AND SMART APPLIANCE

(71) Applicant: LIMOSS (SHENZHEN) CO., LTD., Shenzhen (CN)

(72) Inventor: Christian Gassner, Shenzhen (CN)

(73) Assignee: LIMOSS (SHENZHEN) CO., LTD., Shenzhen (CN)

( * ) Notice: Subject to any disclaimer, the term of this patent is extended or adjusted under 35 U.S.C. 154(b) by 385 days.

(21) Appl. No.: 16/313,223

(22) PCT Filed: Nov. 2, 2017

(86) PCT No.: PCT/CN2017/109153
§ 371 (c)(1),
(2) Date: Dec. 26, 2018

(87) PCT Pub. No.: WO2019/084880
PCT Pub. Date: May 9, 2019

(65) Prior Publication Data

US 2021/0098948 A1 Apr. 1, 2021

(51) Int. Cl.
*H01R 13/71* (2006.01)
*H01R 13/627* (2006.01)
(Continued)

(52) U.S. Cl.
CPC ..... *H01R 13/71* (2013.01); *H01R 13/6271* (2013.01); *H01R 24/62* (2013.01); *H01R 13/652* (2013.01)

(58) Field of Classification Search
CPC .. H01R 13/71; H01R 13/6271; H01R 13/652; H01R 13/703; H01R 13/70; H01R 13/66;
(Continued)

(56) References Cited

U.S. PATENT DOCUMENTS 5,779,489 A * 7/1998 Davis ..... H01R 13/7031 439/79
6,113,426 A * 9/2000 Lin ..... H01R 12/725 439/607.43
(Continued)

FOREIGN PATENT DOCUMENTS

CN 103515792 A 1/2014
CN 204067688 U 12/2014
CN 104810655 A 7/2015

OTHER PUBLICATIONS

International Search Report dated Jul. 31, 2018, issued in counterpart International Application No. PCT/CN2017/109153 (9 pages).

*Primary Examiner* — Harshad C Patel
(74) *Attorney, Agent, or Firm* — Xsensus LLP

(57) ABSTRACT

An USB female socket, a button controller and a smart home. The USB socket may include a housing, a rubber core, and a set of terminals. The housing may define a cavity extending through a front end and a rear end of the housing. The set of terminals may include a first contact terminal and a plurality of second contact terminals. A front end of the first contact terminal may be located below a front end of a second contact terminal adjacent to the first contact terminal and thereby a variable gap may be formed between the front end of the first contact terminal and the front end of the adjacent second contact terminal.

20 Claims, 9 Drawing Sheets

(51) Int. Cl.
*H01R 24/62* (2011.01)
*H01R 13/652* (2006.01)

(58) Field of Classification Search
CPC ..... H01R 13/62; H01R 13/648; H01R 24/60; H01R 24/58
USPC ..... 439/676, 660
See application file for complete search history.

(56) References Cited

U.S. PATENT DOCUMENTS 6,416,359 B1 * 7/2002 Zhang ..... H01R 13/6594 439/607.37
7,431,613 B1 * 10/2008 Liu ..... A47G 19/2288 439/568
7,473,142 B2 * 1/2009 Chien ..... H01R 24/50 200/51.1
7,517,253 B1 * 4/2009 Chiang ..... H01R 12/58 439/218
7,717,745 B2 * 5/2010 He ..... H01R 13/642 439/607.23
7,727,026 B2 * 6/2010 Qin ..... H01R 13/7033 439/660
7,744,382 B2 * 6/2010 Zheng ..... H01R 24/62 439/79
7,748,997 B2 * 7/2010 Hamner ..... H01R 13/65802 439/79
7,758,379 B2 * 7/2010 Chen ..... H01R 13/6485 439/607.11
7,798,832 B2 * 9/2010 Qin ..... H01R 13/7035 439/188
7,841,905 B2 * 11/2010 Zheng ..... H01R 13/658 439/660
8,109,709 B1 * 2/2012 Gaetze ..... E02F 3/404 414/724
8,398,438 B2 * 3/2013 Zhang ..... H01R 13/6471 439/660
8,439,708 B2 * 5/2013 Colantuono ..... H01R 13/6582 439/660
8,574,005 B2 * 11/2013 Wu ..... H02G 3/18 439/536
8,690,608 B2 * 4/2014 Naito ..... H01R 24/60 439/660
8,777,672 B2 * 7/2014 Chung ..... H01R 12/00 439/660
8,956,179 B2 * 2/2015 MacDougall ..... H01R 13/641 439/489
9,281,582 B2 * 3/2016 Hou ..... H01R 13/405
9,520,686 B2 * 12/2016 Hu ..... H01R 24/60
9,543,714 B2 * 1/2017 Chang ..... H01R 13/6272
9,553,411 B2 * 1/2017 Reinhardt ..... H01R 13/516
9,653,851 B1 5/2017 Yuan et al.
9,673,581 B1 * 6/2017 Chuang ..... H01R 31/06
2003/0157836 A1 8/2003 Morikawa et al.
2006/0148300 A1 * 7/2006 Huang ..... H01R 13/6275 439/353
2009/0111330 A1 * 4/2009 Lin ..... H01R 12/7023 439/638
2010/0173529 A1 * 7/2010 He ..... H01R 13/6471 439/660
2010/0216340 A1 * 8/2010 Lin ..... H01R 13/6485 439/607.01
2010/0291800 A1 * 11/2010 Liu ..... H01R 13/518 439/607.58
2011/0159746 A1 * 6/2011 He ..... H01R 13/6473 439/660
2011/0281449 A1 * 11/2011 Ko ..... H01R 13/703 439/188
2012/0052709 A1 * 3/2012 Ko ..... H01R 13/641 439/345
2012/0252278 A1 * 10/2012 Chang ..... H01R 13/6658 439/660
2012/0252279 A1 * 10/2012 Lee ..... H01R 12/724 439/660
2013/0012073 A1 * 1/2013 Wu ..... H02G 3/18 439/660
2013/0171884 A1 * 7/2013 Ho ..... H01R 27/00 439/660
2013/0196544 A1 * 8/2013 Little ..... H01R 13/707 439/626
2013/0210251 A1 * 8/2013 Little ..... H01R 13/7036 439/188
2013/0217272 A1 * 8/2013 Chung ..... H01R 13/6582 439/676
2013/0225010 A1 * 8/2013 Naito ..... H01R 24/62 439/676
2013/0237085 A1 * 9/2013 Kim ..... H01R 13/7031 439/357
2013/0316568 A1 * 11/2013 Yu ..... H01R 24/60 439/485
2014/0120778 A1 * 5/2014 Yu ..... H01R 13/7031 439/660
2015/0111433 A1 * 4/2015 Hou ..... H01R 12/724 439/188
2015/0155664 A1 * 6/2015 Lu ..... H01R 13/405
2016/0006188 A1 * 1/2016 Chang ..... H01R 12/724 439/188
2016/0172800 A1 * 6/2016 Gong ..... H01R 24/60 439/676
2016/0181745 A1 * 6/2016 Hu ..... H01R 13/7031 439/676

* cited by examiner

USB SOCKET, BUTTON CONTROLLER AND SMART APPLIANCE

FIELD OF THE INVENTION

The present application relates to the technical field of smart appliance, and more particularly to a USB socket, a button controller and a smart appliance.

BACKGROUND

In recent years, a concept of smart appliance becomes more and more popular, while the smart appliance is also a development trend of future appliance. Therefore, a smart appliance formed by a combination of traditional appliance (such as a sofa) and an electrical component is necessary. For example, in the prior art, a button controller is usually mounted on a sofa, and then controlled to realize automation operation of the sofa. In order to provide the button controller with a plurality of functions, an universal serial bus (USB) socket can be arranged on the button controller, so that a data cable with a USB plug can be plugged to the USB socket to charge an electronic product. However, the USB socket of the prior art is arranged on the button controller, and thus the button controller is usually in a standby state because a contact terminal built in the USB socket is always in a powered state. As a result, the button controller always has a certain voltage output, thereby resulting in unnecessary loss of power consumption.

BRIEF SUMMARY

One purpose of the present invention is to provide a USB socket, a button controller and a smart appliance, which are intended to overcome the problem in the prior art that contact terminals built-in the USB socket applied to the button controller are always powered on and that the button controller is always on standby state when being not in use.

Accordingly, some embodiments of the present invention provide a USB socket, which includes a housing, a rubber core, and a set of terminals. The housing may define a cavity extending through a front end and a rear end of the housing. The rubber core may be mounted in the cavity. The set of terminals may be mounted on the rubber core. The set of terminals may include a first contact terminal and a plurality of second contact terminals. The first contact terminal and each of the second contact terminals may be arranged side by side. A rear end of the first contact terminal and a rear end of each of the second contact terminals may extend outward from a rear end of the housing, and a front end of each of the second contact terminals may be exposed on the rubber core and located in the cavity. A front end of the first contact terminal may be located below the front end of a second contact terminal adjacent to the first contact terminal. An elastic or variable gap may be formed between the front end of the first contact terminal and the front end of the second contact terminal. When a USB plug is plugged into the cavity, the front end of the first contact terminal may contact the front end of the second contact terminal pressed by the USB plug.

Preferably, the front end of the second contact terminal adjacent to the first contact terminal defines a bent elastic portion and a flat abutting portion extending from an end of the bent elastic portion, the bent elastic portion is exposed on the rubber core and located in the cavity, and the elastic or variable gap is formed between the flat abutting portion and the front end of the first contact terminal.

Preferably, the front end of the first contact terminal extends toward a side of its adjacent second contact terminal to form a base abutting portion configured to contact with the flat abutting portion, and the elastic or variable gap is formed between the base abutting portion and the flat abutting portion.

Preferably, the rubber core defines a first terminal groove configured to receive the first contact terminal and second terminal grooves configured to receive the second contact terminals, the first contact terminal is embedded in the first terminal groove, the second contact terminal is embedded in the second terminal groove, and a front end of the first terminal groove is in communication with an front end of the adjacent second terminal groove so as to allow the base abutting portion to be located below the flat abutting portion.

Preferably, a periphery of the front end of the housing is provided with a protruding curve edge bent outward to facilitate insertion of the USB male socket into the cavity side.

Preferably, a periphery of the rear end of the housing is provided with a bending edge bent outward to enhance the stability of the connection of the housing with an external component.

Preferably, first elastic pieces bent toward the cavity for abutting against the USB male socket are stamped out on both a top surface and a bottom surface of the housing.

Preferably, second elastic pieces bent toward the cavity for abutting against the USB male socket are stamped out on both sides of the housing.

In the USB socket according to some embodiments of the present application, when the USB plug is not plugged into the cavity, the front end of the first contact terminal of the USB socket does not contact the front end of the adjacent second contact terminal, so no electrical connection occurs. In this way, the button controller with the USB socket cannot realize a full path, and there will be no 5V voltage output, so that the button controller achieves the zero standby function. When the USB male socket is plugged into the USB socket, the front end of the first contact terminal of the USB socket contacts the front end of the adjacent second contact terminal. As such, the electrical connection occurs to allow the button controller with the USB socket to realize the full path, and there will be 5V voltage output to the USB socket for achieving work. The USB socket of the present application can enable the button controller to be in the zero standby state when being not in use, thereby avoiding power consumption loss.

Another example of the present invention is a button controller which includes a controller body, wherein the controller body is provided with the above USB socket.

Because the button controller of the present application applies the above USB socket, it is ensured that the button controller can achieve zero standby state when the USB socket is not plugged to the USB male socket, so as to avoid power consumption loss.

Another example of the present invention is a smart appliance which includes a furniture or appliance body, wherein the furniture or appliance body is provided with the above button controller according to one embodiment of the present invention.

Because the smart appliance of the present application applies the above button controller, it is ensured that the button controller can achieve zero standby state when the USB socket of the button controller is not plugged by the USB plug, so as to avoid power consumption loss.

BRIEF DESCRIPTION OF THE DRAWINGS

In order to describe the technical solutions in the embodiments of the present application more clearly, accompanying drawings required for describing the embodiments or the prior art will be briefly introduced. Apparently, the accompanying drawings in the following description are merely the embodiments of the present application, and other drawings may be obtained by those skilled in the art according to these accompanying drawings without paying any creative labor.

DETAILED DESCRIPTION

Figure 1:
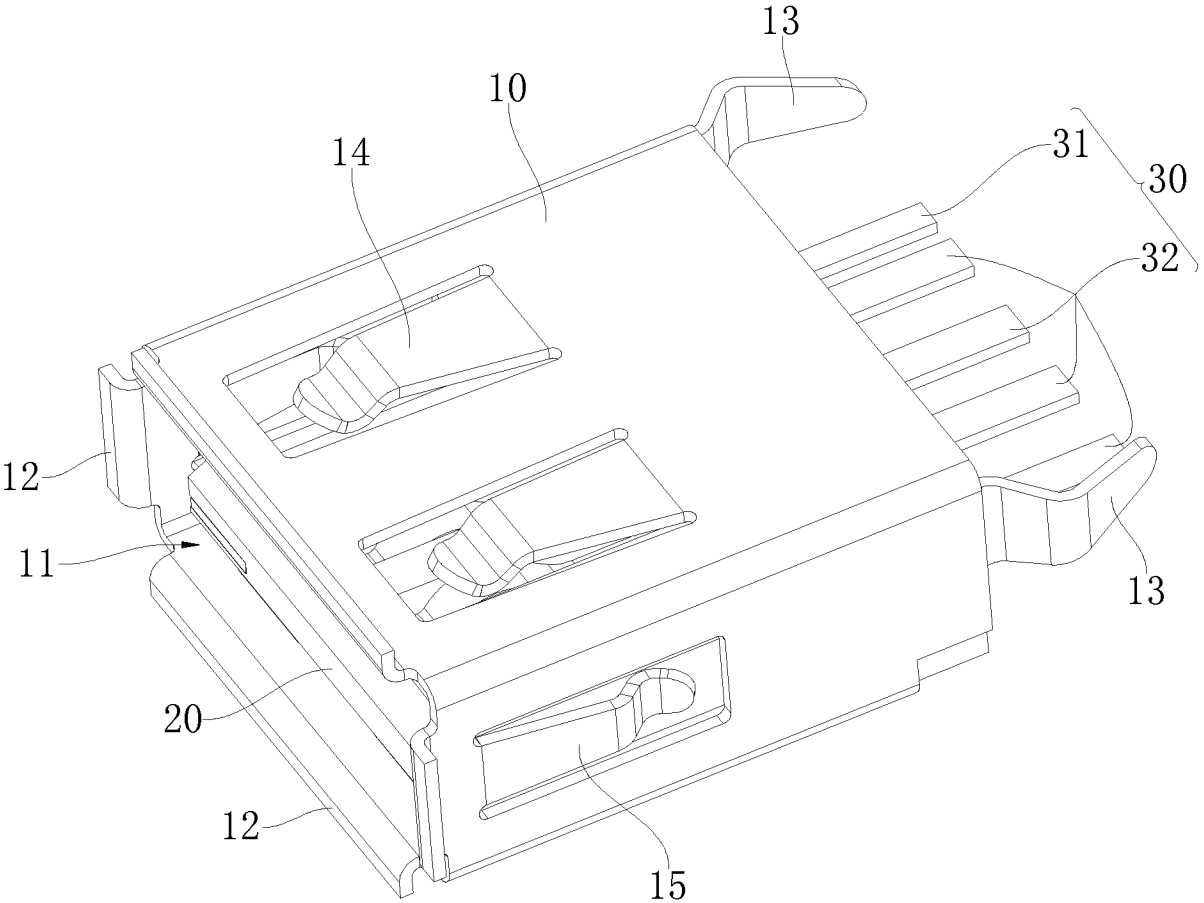
FIG. 1 is a first structural schematic view of a USB socket provided by an embodiment of the present application.

The embodiments of the present invention are described in detail below, and examples of the embodiments are shown in the accompanying drawings, wherein same or similar reference labels denote the same or similar elements or elements having the same or similar functions from beginning to end. The embodiments described below with reference to FIG. 1 to FIG. 9 are exemplary, and are merely intended to explain the present invention, but should not be construed as limiting the present invention.

In the description of the present invention, it should be understood that the terms "length", "width", "up", "down", "front", "rear", "left", "right", "vertical", "horizontal", "top", "bottom", "inside", "outside" and the like are based on the orientation or the positional relationship shown in the accompanying drawings for the convenience of describing the present invention and the simplified description, rather than indicating or implying that the device or element must have a particular orientation, and be constructed and operated in a particular orientation, therefore should not be construed as limiting the present invention.

In addition, the terms "first" and "second" are merely used for describing the purposes, and are not to be construed as indicating or implying relative importance or implicitly indicating the number of indicated technical features. Thus, features defining "first" and "second" may explicitly or implicitly include one or more of the features. In the description of the present invention, the meaning of "a plurality of" is two or more, unless otherwise expressly stated.

In the present invention, terms such as "mounted", "linked", "connected", and "fixed" should be broadly understood unless otherwise expressly stated and limited. For example, it can be fixedly connected, removably connected, or integrated. It can be a mechanical connection or an electrical connection; it can be directly connected or indirectly connected through an intermediate medium, which can be the internal connection of two elements or the interaction of two elements. For those skilled in the art, the specific meanings of the above terms in the present invention may be understood based on specific situations.

As shown in FIGS. 1 to 8, one embodiment of the present application provides a USB socket, which includes a housing 10, a rubber core 20 and a set of terminals 30. The housing 10 defines a cavity 11 extending through a front end and a rear end of the housing 10. The rubber core 20 is mounted in the cavity 11, and the set of terminals 30 is mounted on the rubber core 20. The set of terminals 30 includes a first contact terminal 31 and a plurality of second contact terminals 32, and the first contact terminal 31 and each of the second contact terminals 32 are arranged side by side. A rear end of the first contact terminal 31 and a rear end of each of the second contact terminals 32 extend out of a rear end of the housing 10. A front end of each of the second contact terminals 32 is exposed out of the rubber core 20 and located within the cavity 11. A front end of the first contact terminal 31 is located below the front end of its adjacent second contact terminal 32. An elastic or variable gap 33 is formed between the front end of the first contact terminal 31 and the front end of the second contact terminals 32. In this way, when a USB plug 40 is plugged into the cavity 11, the front end of the first contact terminal 31 is contacted with the front end of the second contact terminal 32 pressed by the USB plug 40. The USB socket of this embodiment of the present application can make the button controller achieve zero standby state when being not in use, so as to avoid power consumption loss.

In some embodiments of the present application, the USB socket is mounted into the button controller. The first contact terminal 31 is connected with a first ground terminal of an electronic device, and the adjacent second contact terminal 32 is connected with a second ground terminal of the electronic device. When the USB plug 40 is not plugged in the cavity 11, the front end of the first contact terminal 3 of the USB socket is not contacted with the adjacent second contact terminal 32 thereof, so no electrical connection occurs, that is, the first ground terminal is not electrically connected with the second ground terminal. In this way, the button controller with the USB socket cannot realize a full path, and there will be no 5V voltage output. As a result, the button controller achieves the zero standby function. When the USB plug 40 is plugged into the USB socket, the front end of the first contact terminal 31 of the USB socket contacts the front end of the adjacent second contact terminal 32, and thus the electrical connection occurs, that is, the first ground terminal is connected with the second ground terminal. Therefore, the button controller with the USB socket realizes the full path, and there will be 5V voltage output to the USB socket for achieving work.

In some embodiments, as shown in FIGS. 3 to 4 and FIGS. 7 to 8, the front end of the second contact terminal 32 adjacent to the first contact terminal 31 includes a bent elastic portion 322 and a flat abutting portion 321 extending distally from an end of the bent elastic portion 322. The bent elastic portion 322 is exposed on the rubber core 20 and located within the cavity 11, and the elastic or variable gap 33 is formed between the flat abutting portion 321 and the front end of the first contact terminal 31. Specifically, by the arrangement of the bent elastic portion 322 disposed on the front end of the second contact terminal 32 adjacent to the first contact terminal 31, it can be ensured that the bent elastic portion 322 deforms and presses down when being subjected to the pressure of the USB plug 40 plugged in the cavity 11, thereby driving the flat abutting portion 321 extended from the front end of the bent elastic portion 322 down and contact the front end of the first contact terminal 31, so as to realize the electrical connection between the first contact terminal 31 and the second contact terminal 32. Once the USB plug 40 is removed, the force applied to press down the bending elastic portion 322 is also removed, so that the bending elastic portion 322 restores its original state and makes the flat contact portion 321 restore its original state and break away from the abutment of the front end of the first contact 31, thereby achieving a power-off state. There will be no 5V voltage output, so that the button controller achieves the zero standby function. The structural design of the present invention is ingenious, and the practicality is high.

In some embodiments, as shown in FIGS. 3 to 4 and FIGS. 7 to 8, the front end of the first contact terminal 31 extends toward a side of its adjacent second contact terminal 32 to form a base abutting portion 311 configured to contact the flat abutting portion 321, and the elastic or variable gap 33 is formed between the base abutting portion 311 and the flat abutting portion 321. Specifically, the base abutting portion 311 extended from a side of the front end of the first contact terminal 31 can ensure that the front end of the first contact terminal 31 is located below the flat abutting portion 321 of the front end of the adjacent second contact terminal 32 spaced apart from the first contact terminal 31. In this way, although the first contact terminal 31 is spaced apart from the second contact terminal 32, it can still be ensured that the base abutting portion 311 of the first contacting end 31 is located below the flat abutting portion 321 of the second contacting terminal 32, so as to further ensure that the elastic or variable gap 33 is formed between the first contact terminal 31 and the second contact terminal 32. In this way, when the USB socket is not in use, the elastic or variable gap 33 makes the flat abutting portion 321 and the base abutting portion 311 to disconnect from each other. When the USB socket is in use, due to the action of the USB plug 40, the flat abutting portion 321 contacts the base abutting portion 311 to achieve the electrical connection and work.

Figure 5:
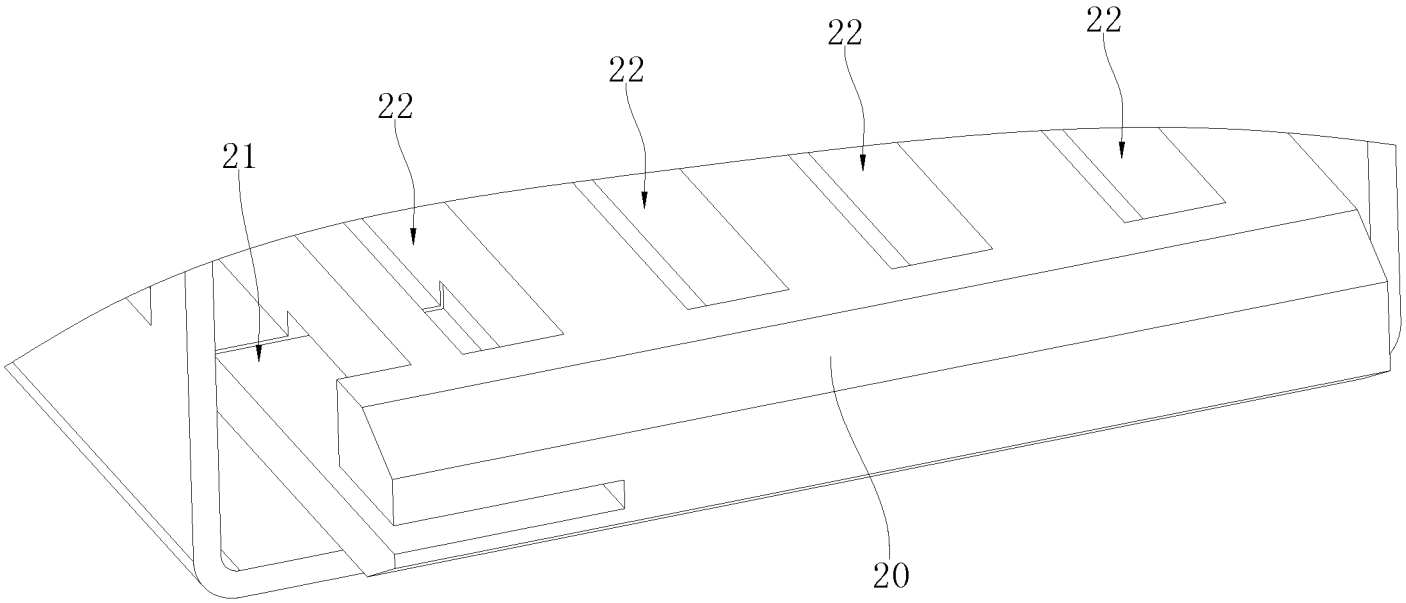
FIG. 5 is a partial structural schematic view of a rubber core of the USB socket provided by an embodiment of the present application.
Figure 6:
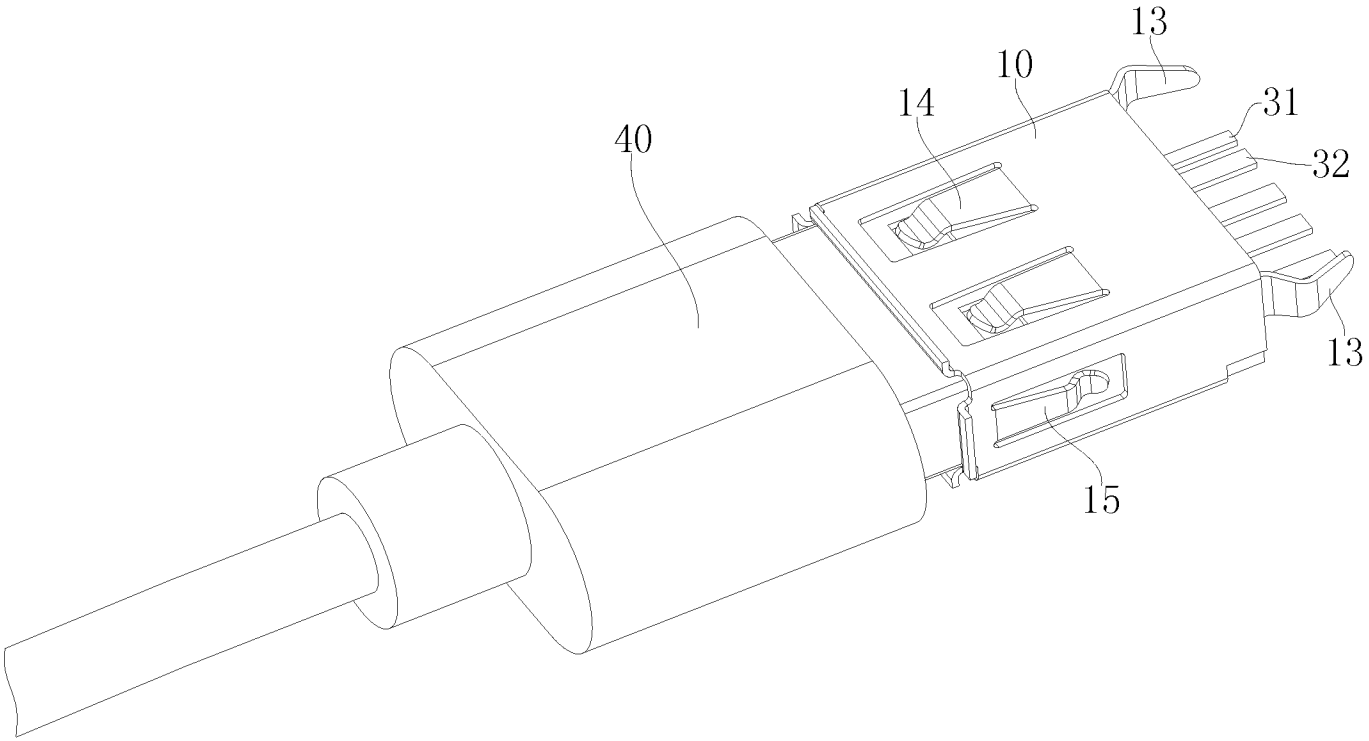
FIG. 6 is a structural schematic view of the USB socket cooperated with the USB male socket provided by an embodiment of the present application.
Figure 7:
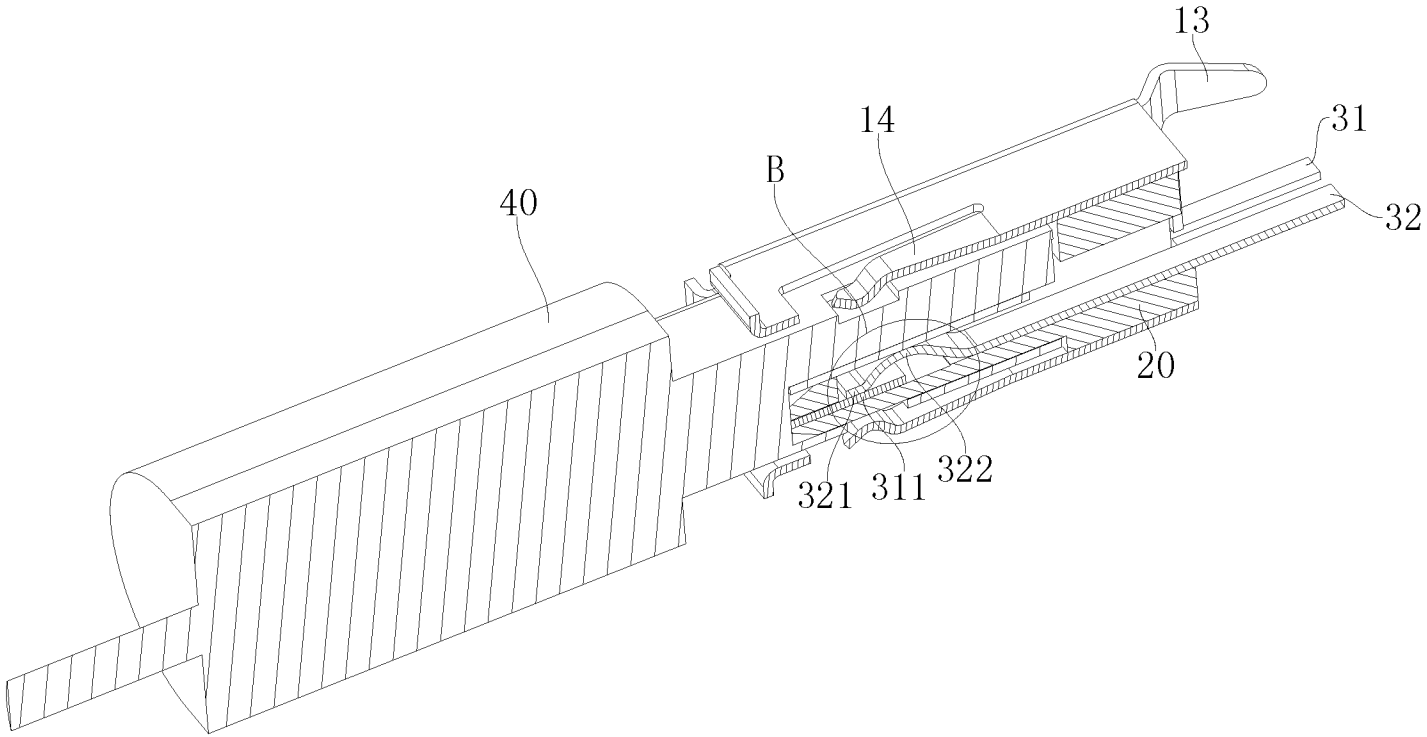
FIG. 7 is a cross-sectional view of the USB socket cooperated with the USB male socket provided by an embodiment of the present application.
Figure 8:
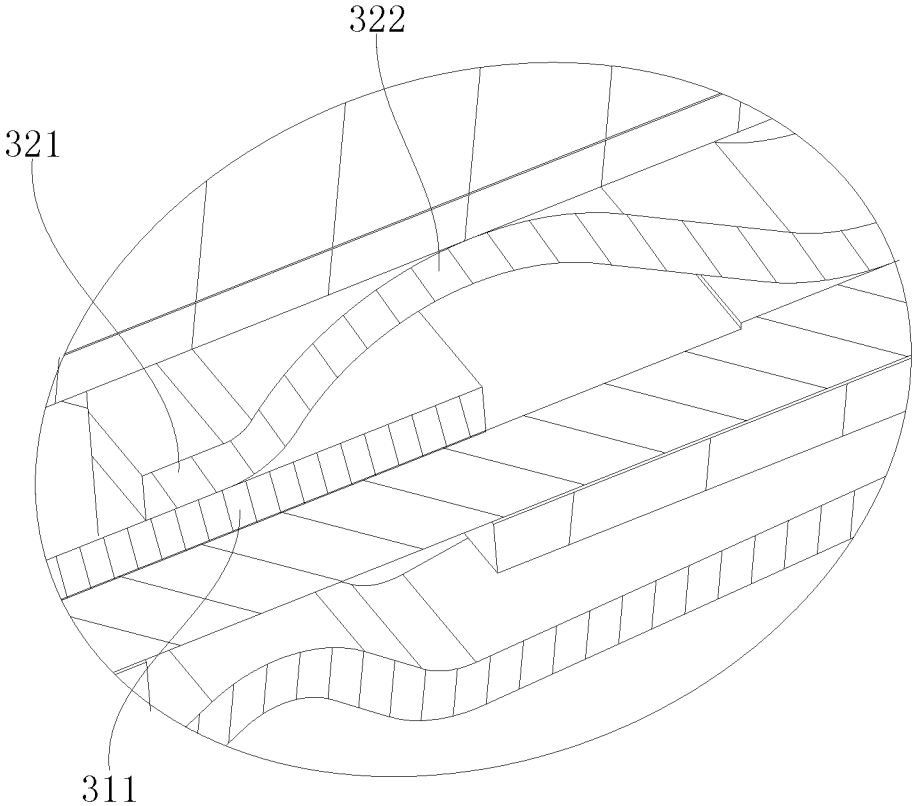
FIG. 8 is an enlarged schematic view of a local structure of the part B of FIG. 7.

In some embodiments, as shown in FIG. 5, the rubber core 20 includes a first terminal groove 21 configured to hold the first contact terminal 31 and second terminal grooves 22 configured to hold each of the second contact terminals 32 respectively. The first contact terminal 31 is embedded in the first terminal groove 21, the second contact terminals 32 are embedded in the second terminal grooves 22, and a front end of the first terminal groove 21 is in connection with an adjacent front end of the second terminal groove so as to allow the base abutting portion 311 to be located below the flat abutting portion 321. Specifically, an arrangement of the first terminal groove 21 is configured for holding and fixing the first contact terminal 32. Similarly, an arrangement of the second terminal grooves 22 are configured for holding and fixing the second contact terminals 32. The design in which the front end of the first terminal groove 21 is in communication with the front end of the adjacent second terminal groove 22 can ensure that the base abutting portion 311 of the first contact terminal 31 protrudes below the flat abutting portion 321 of the second contact terminal 32. Therefore, the elastic or variable gap 33 is formed between the base abutting portion 311 and the flat abutting portion 321.

Figure 2:
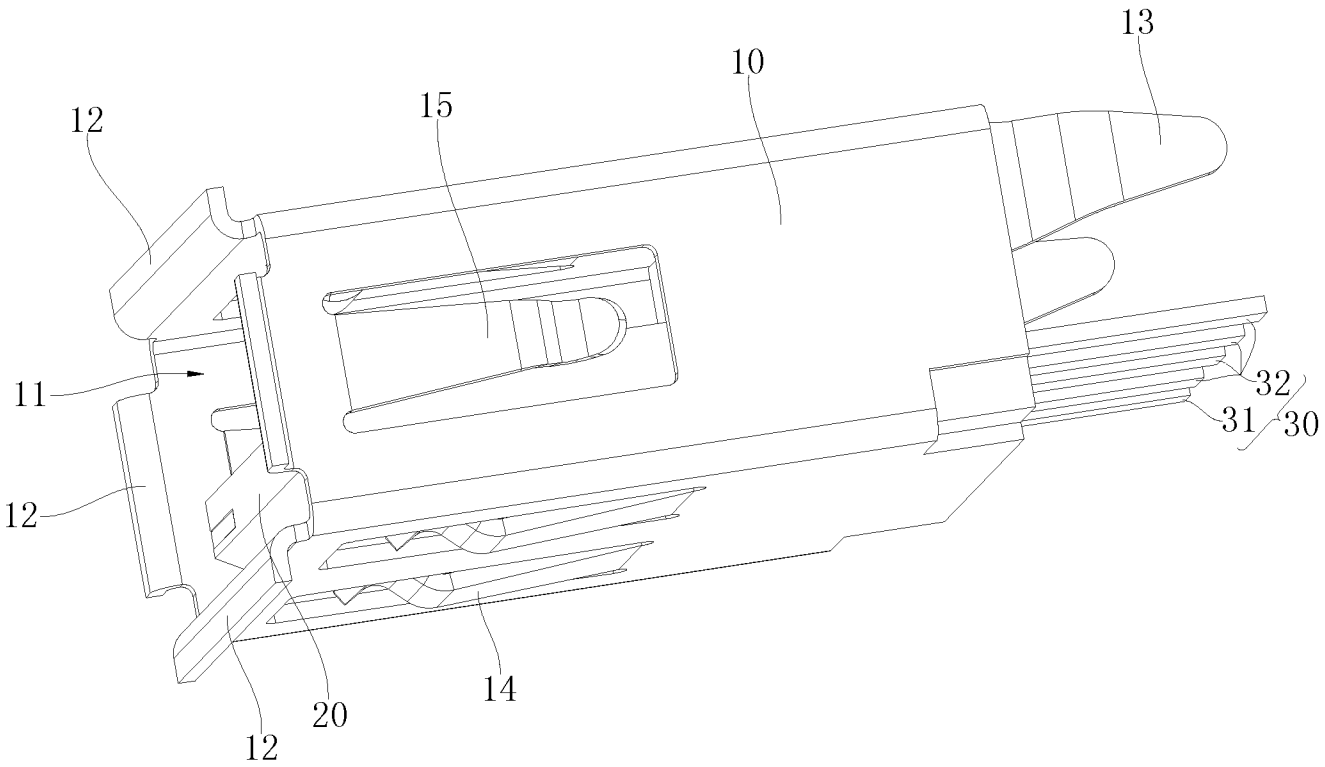
FIG. 2 is a second structural schematic view of the USB socket provided by an embodiment of the present application.
Figure 3:
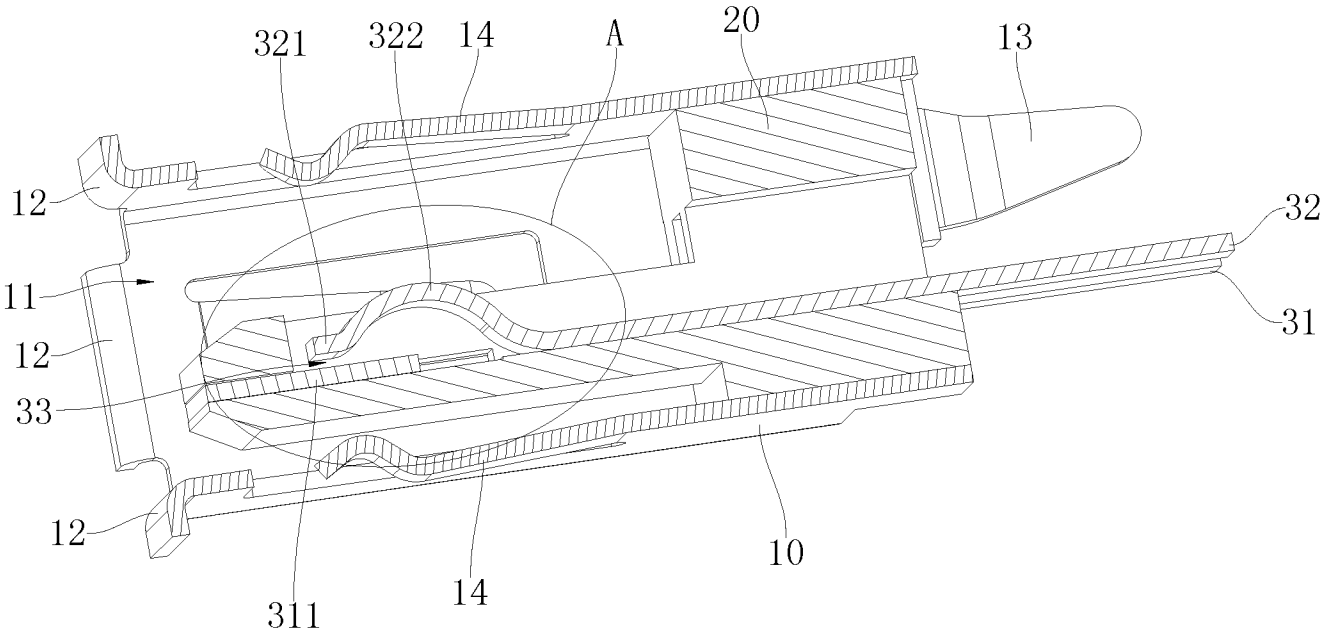
FIG. 3 is a cross-sectional view of the USB socket provided by an embodiment of the present application.
Figure 4:
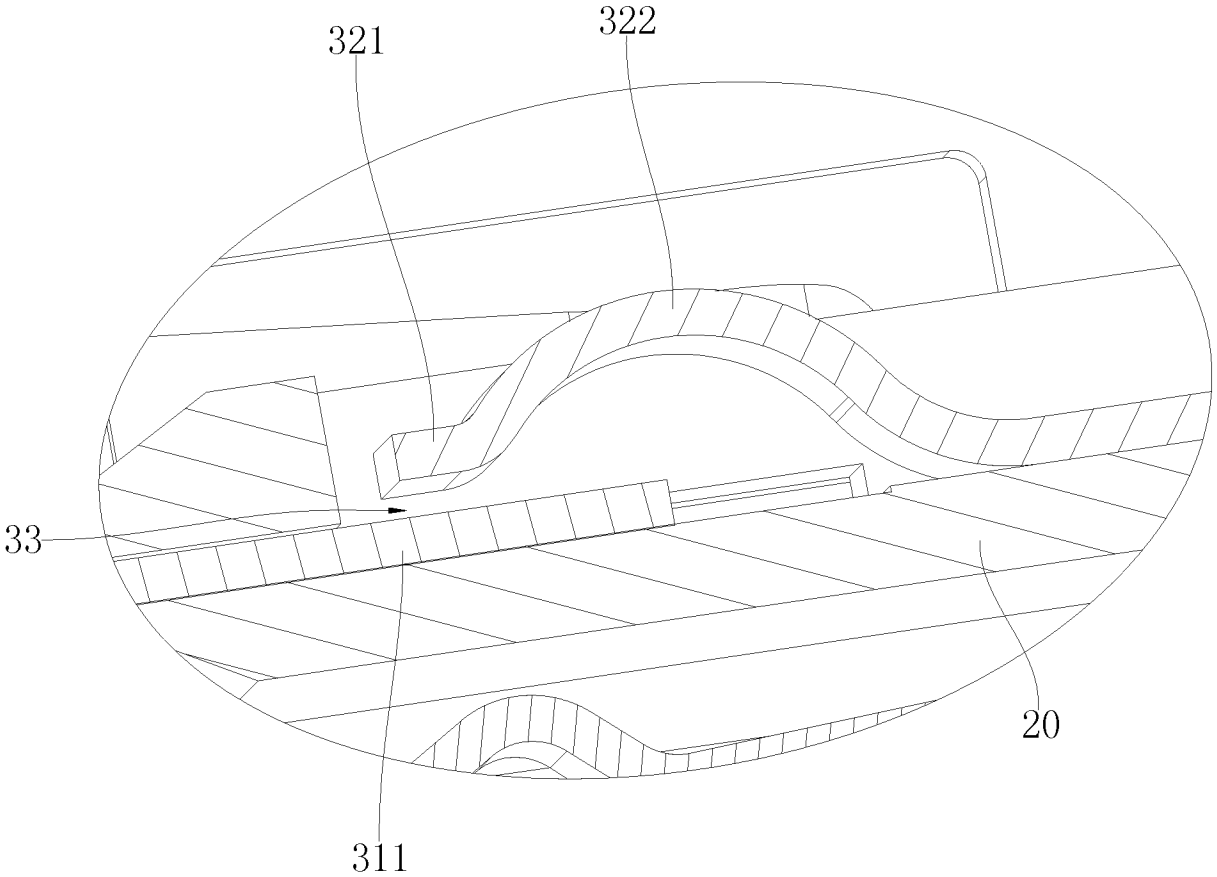
FIG. 4 is an enlarged schematic view of a local structure of the part A of FIG. 3.

In some embodiments, as shown in FIGS. 1 to 3, a periphery of the front end of the housing 10 is provided with a protruding curve edge 12 bent outward to facilitate insertion of the USB plug 40 into the cavity 11. Specifically, an arrangement of the protruding curve edge 12 can make the front end of the housing 11 to form an arc shape, so as to guide the USB plug 40 to be inserted into the cavity 11 of the housing 10. The protruding curve edge 12 has a guiding function to speed up the match between the USB plug 40 and the USB socket.

In some embodiments, as shown in FIGS. 1 to 3, a periphery of the rear end of the housing 10 is provided with a bending edge 13 bent outward to enhance the connection stability between the housing 10 and an external component. Specifically, an arrangement of the bending edge 13 can strengthen a fastening force of the housing 10 fixed to an external component (such as an electronic device), so that the mounting of the entire USB socket is more stable and reliable.

In some embodiments, as shown in FIGS. 1 to 3, first elastic pieces 14 bent toward the cavity 11 for abutting against the USB male socket 40 are formed on both a top portion and a bottom portion of the housing 11. Specifically, each of the first elastic pieces 14 is configured to press against a USB plug working surface inserted in the cavity 11, increase the friction between the USB socket and the USB plug 40, and further increase the stability and reliability of the insertion connection between the USB socket and USB plug 40.

In some embodiment, as shown in FIGS. 1 to 3, second elastic pieces 15, which bend toward the cavity 11 for abutting against the USB male socket 40, are formed on both sides of the housing 10. Similarly, each of the second elastic pieces 15 is configured to press against a USB plug working surface inserted in the cavity 11, increase the friction between the USB socket and the USB plug 40, and further increase the stability and reliability of the insertion connection between the USB socket and USB plug 40.

Figure 9:
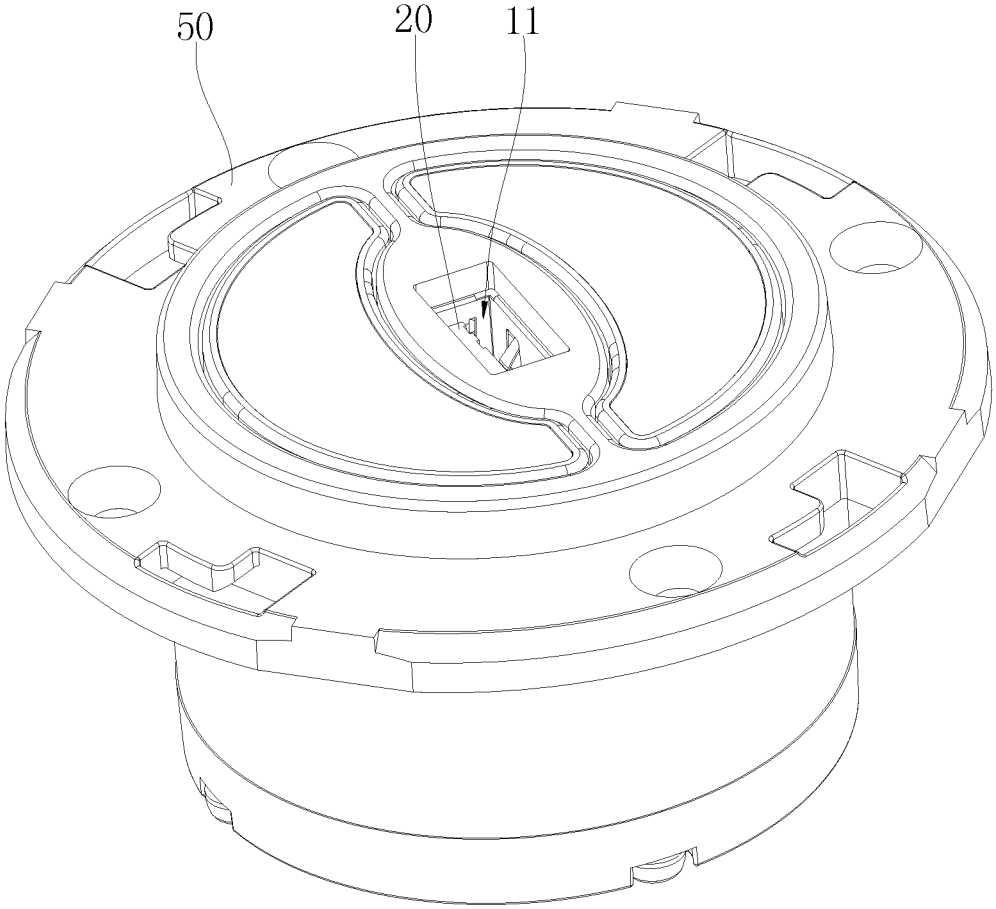
FIG. 9 is a structural schematic view of a controller body provided by an embodiment of the present application.

As shown in FIG. 9, an embodiment of the present application further provides a button controller including a controller body 50. The above USB socket according to one embodiment of the present invention is arranged on the controller body 50. Because the above USB socket is applied to the button controller of the embodiment of the present application, it be can ensured that the button controller achieves zero standby state when the USB socket is not plugged to the USB male socket, so as to avoid power consumption loss.

An embodiment of the present application further provides a smart appliance including a furniture or appliance body. The button controller is arranged on the furniture or appliance body. Because the above button controller is applied to the smart appliance of the embodiment of the present application, so it can be ensured that the button controller achieve zero standby state when the USB socket of the button controller is not plugged to the USB plug, so as to avoid power consumption loss.

The smart appliance of the embodiment of the present application can be a functional sofa or the like.

The above contents are only preferred embodiments of the present application, and are not intended to limit the present application. Any improvements, equivalent replacements and modifications made within the spirit and principle of the present application should be contained within the protection scope of the present application.

Reference labels in the accompanying drawings:

10—housing; 11—cavity, 12—protruding curve edge, 13—bending edge, 14—first elastic piece, 15—second elastic piece, 20—rubber core, 21—first terminal groove, 22—second terminal groove, 30—terminal assembly, 31—first contact terminal, 32—second contact terminal,

33—elastic or variable gap, 40—USB male socket, 50—controller body, 311—base butting portion, 321—flat abutting portion, 322—bent elastic portion.

What is claimed is:

1. A USB socket, comprising a housing, a rubber core, and a set of terminals;

wherein the housing defines a cavity extending through a front end and a rear end of the housing, the set of terminals comprises a first contact terminal and a plurality of second contact terminals, a front end of the first contact terminal is located below a front end of a second contact terminal adjacent to the first contact terminal and thereby a variable gap is formed between the front end of the first contact terminal and the front end of the adjacent second contact terminal, wherein the variable gap is configured so that the front end of the first contact terminal is in physical contact with the front end of the adjacent second contact terminal when a USB plug is plugged into the cavity.

2. The USB socket of claim 1, wherein the first contact terminal and each of the second contact terminals are arranged side by side, a rear end of the first contact terminal and a rear end of each of the second contact terminals extend out of the rear end of the housing, and the front end of each of the second contact terminals is exposed out of the rubber core and located within the cavity.

3. The USB socket of claim 1, wherein the variable gap is configured to electrically disconnect the front end of the first contact terminal and the front end of the adjacent second contact terminal when the USB plug is not plugged into the cavity.

4. The USB socket of claim 3, wherein a periphery of the front end of the housing is provided with a protruding curve edge bent outward, and the protruding curve edge is configured to facilitate insertion of the USB plug into the cavity.

5. The USB socket of claim 3, wherein a periphery of the rear end of the housing is provided with a bending edge bent outward, and the bending edge is configured to enhance the stability of connection of the housing with an external component.

6. The USB socket of claim 3, wherein a plurality of second elastic pieces bent toward the cavity for abutting against the USB plug are formed on both sides of the housing.

7. A button controller, comprising a controller body, wherein the controller body is provided with the USB socket according to claim 3.

8. The USB socket of claim 3, wherein a plurality of first elastic pieces bent toward the cavity for abutting against the USB plug are formed on both a top surface and a bottom surface of the housing.

9. The USB socket of claim 1, wherein the front end of the adjacent second contact terminal comprises a bent elastic portion and a flat abutting portion extending distally from an end of the bent elastic portion, the bent elastic portion is exposed out of the rubber core and located within the cavity, and the variable gap is formed between the flat abutting portion and the front end of the first contact terminal.

10. The USB socket of claim 9, wherein the front end of the first contact terminal comprises a base abutting portion, and the variable gap is formed between the base abutting portion and the flat abutting portion.

11. The USB socket of claim 10, wherein the rubber core comprises a first terminal groove configured to hold the first contact terminal and second terminal grooves configured to hold the second contact terminals, and a frond end of the first terminal groove is in connection with a front end of the adjacent second terminal groove so as to allow the base abutting portion to be located below the flat abutting portion.

12. The USB socket of claim 11, wherein a periphery of the front end of the housing is provided with a protruding curve edge bent outward, and the protruding curve edge is configured to facilitate insertion of the USB plug into the cavity.

13. The USB socket of claim 10, wherein a periphery of the front end of the housing is provided with a protruding curve edge bent outward, and the protruding curve edge is configured to facilitate insertion of the USB plug into the cavity.

14. The USB socket of claim 10, wherein a periphery of the rear end of the housing is provided with a bending edge bent outward, and the bending edge is configured to enhance the stability of connection of the housing with an external component.

15. The USB socket of claim 10, wherein a plurality of second elastic pieces bent toward the cavity for abutting against the USB plug are formed on both sides of the housing.

16. A smart appliance, wherein the smart appliance is provided with the button controller of claim 15.

17. The smart appliance of claim 16, wherein the smart appliance is a sofa.

18. The USB socket of claim 1, wherein a periphery of the rear end of the housing is provided with a bending edge bent outward, and the bending edge is configured to enhance the stability of connection of the housing with an external component.

19. The USB socket of claim 10, wherein a plurality of first elastic pieces bent toward the cavity for abutting against the USB plug are formed on both a top surface and a bottom surface of the housing.

20. A button controller, comprising a controller body, wherein the controller body is provided with the USB socket according to claim 1.

* * * * *